US008686263B2

(12) United States Patent
Chen

(10) Patent No.: US 8,686,263 B2
(45) Date of Patent: Apr. 1, 2014

(54) MUSICAL INSTRUMENT

(76) Inventor: Kuo-Chang Chen, Taichung (TW)

( * ) Notice: Subject to any disclaimer, the term of this patent is extended or adjusted under 35 U.S.C. 154(b) by 219 days.

(21) Appl. No.: 13/353,618

(22) Filed: Jan. 19, 2012

(65) Prior Publication Data

US 2013/0186257 A1 Jul. 25, 2013

(51) Int. Cl.
*G10D 9/04* (2006.01)

(52) U.S. Cl.
USPC ..... 84/380 R

(58) Field of Classification Search
USPC ..... 84/380 R, 387 R, 387 A
See application file for complete search history.

(56) References Cited

U.S. PATENT DOCUMENTS 3,811,357 A * 5/1974 Stewart ..... 84/327

* cited by examiner

*Primary Examiner* — Kimberly Lockett

(57) ABSTRACT

The present invention provides a hinge tube which is disposed in a musical instrument to connect to keys and valves of the musical instrument. The hinge tube forms at least one recess portion on a periphery of the hinge tube. Thereby, the positions on which the valves and the keys disposed are able to be identified easily, and the valves and the keys are fixed to the hinge tube more firmly to improve the stability of the musical instrument.

7 Claims, 5 Drawing Sheets

MUSICAL INSTRUMENT

BACKGROUND OF THE INVENTION

1. Field of the Invention

The present invention relates to a musical instrument, more especially to a hinge tube of a wind instrument.

2. Description of the Prior Art

A wind instrument, especially a saxophone or other woodwind instrument, produces tones with different frequency by opening or shutting the tone holes on the instrument to change the effective length of the instrument. To make controlling each tone hole easier, a hinge tube and valves are disposed on a plurality of instruments, as disclosed in TW 371096, TW 371097, TW M420798, and U.S. Pat. No. 7,608,768. The keys drive the hinge tube to rotate, and the valves fixed to the hinge tube also rotate and open or shut the tone holes.

The hinge tubes disclosed in the patents mentioned above are principally circular rods or polygonal rods, and the valves are fixed on the hinge tube. Due to the simple shape and the smooth surface of the hinge tube, the valves are fixed unstably frequently. Moreover, a maker can not confirm the positions to which the valves should be fixed when manufacturing. The positions of valves have to be confirmed over and over, and the efficiency of manufacture is low.

The present invention, therefore, makes improvements on the disadvantages as mentioned above.

SUMMARY OF THE INVENTION

The main object of the present invention is to provide a hinge tube on which valves can be disposed more firmly. Also, the hinge tube of the present invention is easy to manufacture.

To achieve the above and other objects, a hinge tube is disposed rotatably in a musical instrument and connects to at least one key and at least one valve.

The hinge tube has at least one periphery surrounding it. The periphery extends from one end to the other end of the hinge tube. At least one recess portion is formed on the periphery.

Thereby, the recess portions of the hinge tube of the present invention are available for the keys and the valves to be disposed on. Also, a maker can confirm the positions of the keys and the valves by the recess portions to promote the efficiency of manufacture. Besides, the surface area of the hinge tube is larger than conventional due to the recess portions, and the space between the hinge tube and the keys or the valves is larger too. Thus, the valves and the keys can be fixed to the hinge tube more filmy to enhance the stability of the instrument.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
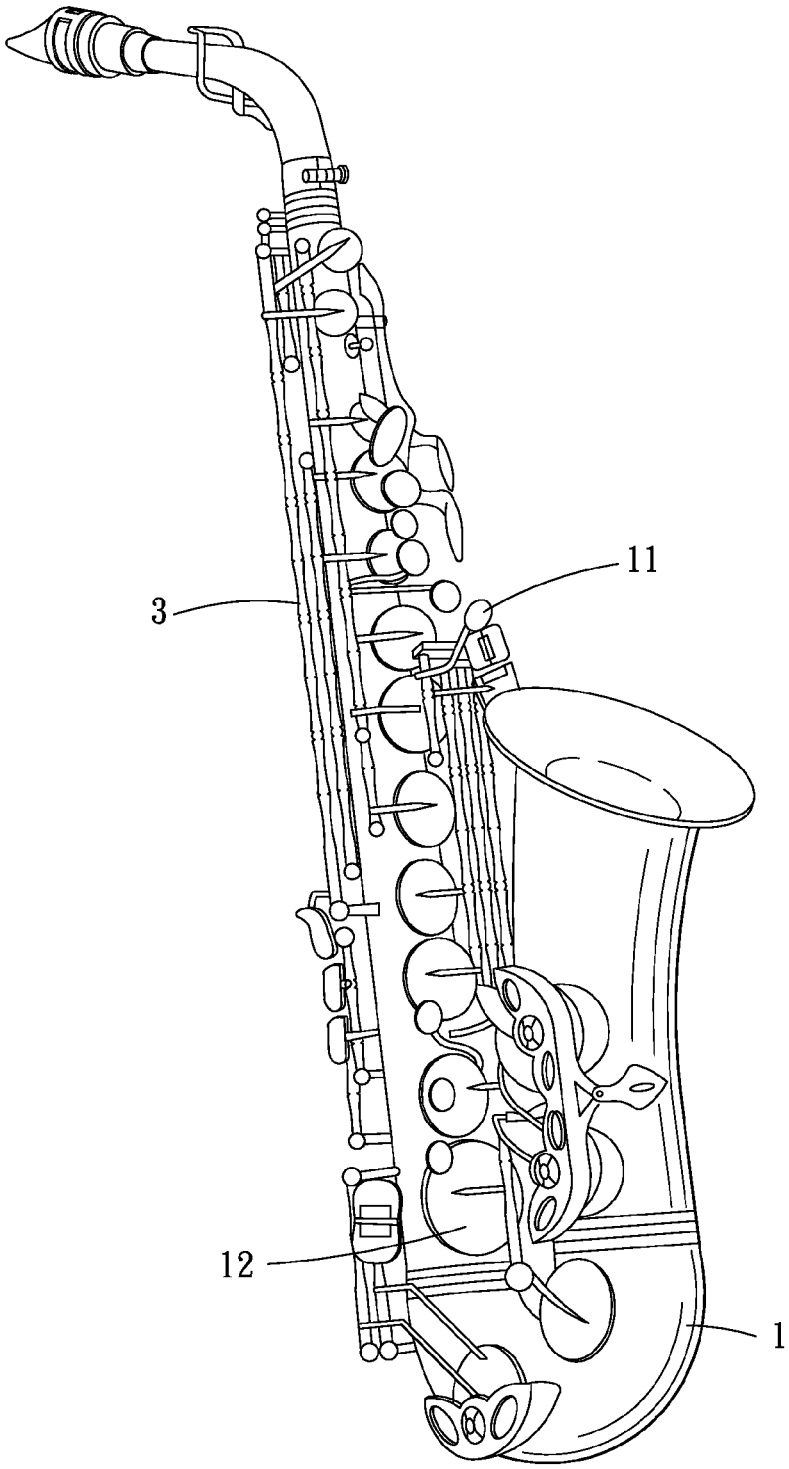
FIG. 1 is a stereogram showing a hinge tube and a musical instrument including the same of the present invention.
Figure 2:
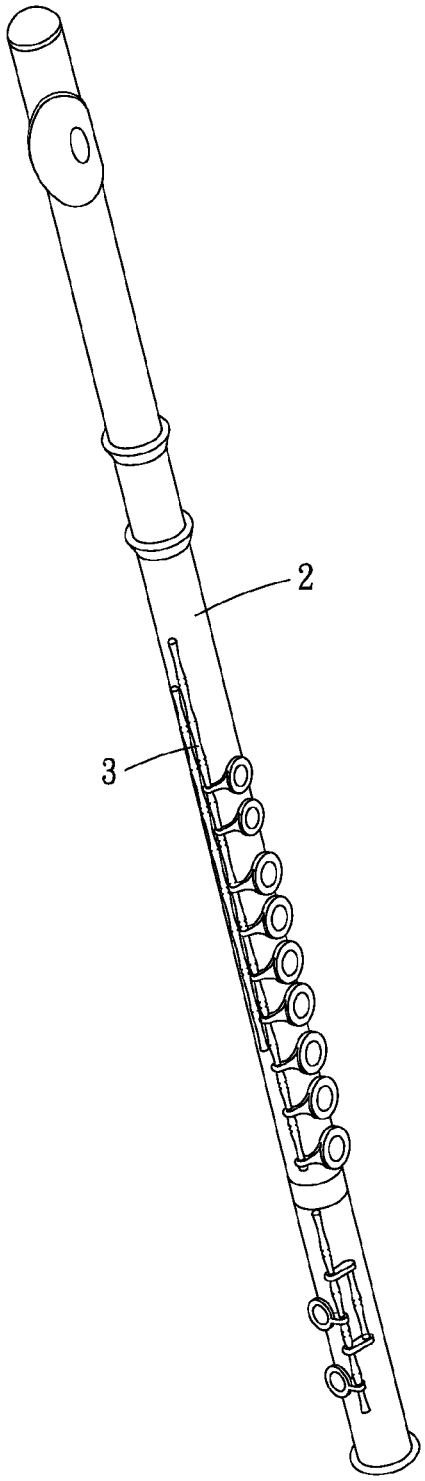
FIG. 2 is a stereogram showing a hinge tube and another musical instrument including the same of the present invention.

Please refer to FIG. 1 and FIG. 2, the hinge tube of the present invention is available to be disposed in a musical instrument, such as a saxophone shown in FIG. 1, a flute shown in FIG. 2, or any wind instrument with tone holes. The hinge tube of the present invention is connected by keys 11 and valves 12 of a musical instrument. The keys 11 can drive the hinge tube of the present invention to rotate to enable the valves 12 to shut or to open the tone holes, and then the pitch of the instrument is able to be changed.

Figure 3:
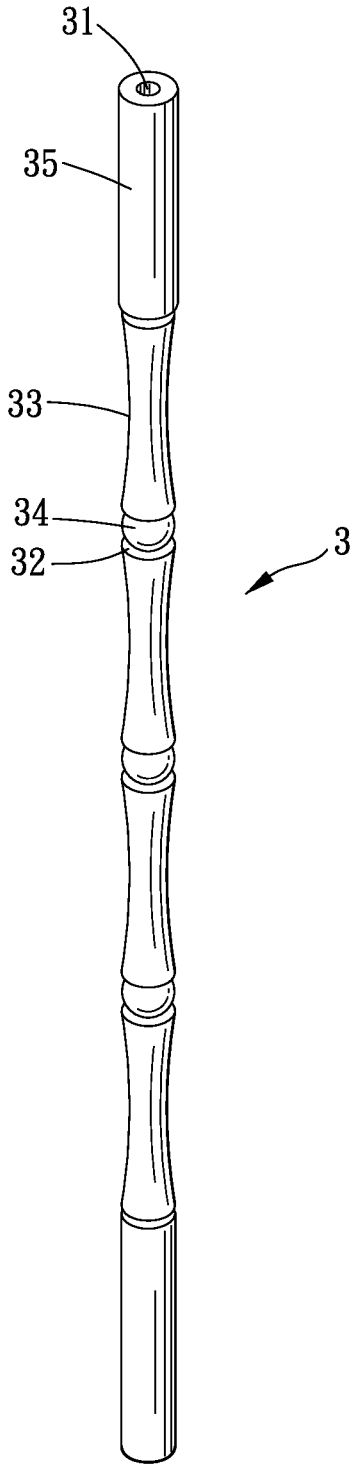
FIG. 3 is a stereogram showing a hinge tube of the present invention.
Figure 4:
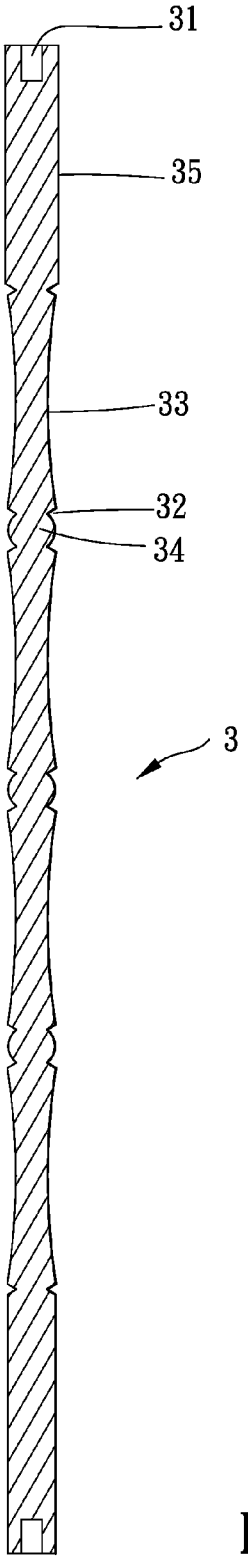
FIG. 4 is a cross-section view showing a hinge tube of the present invention.

Please refer to FIG. 3 and FIG. 4, the hinge tube 3 of the present invention has a periphery surrounding it, and the periphery extends from one end to the other end of the hinge tube 3. The hinge tube 3 can be a circular rod, a polygonal rod, or a noncircular rod to accommodate to acquirement of using or manufacturing. Generally speaking, the hinge tube 3 can be made of the material similar to the instrument, such as copper or nickel. However, other special material can be taken into consideration to accommodate to special demands such as lightweight, higher strength, sound-absorption, or resonance.

The hinge tube 3 forms a fovea 31 at each of the two opposite ends of the hinge tube 3 to be inserted by a screw or a bolt to fix the hinge tube 3 to the instrument. The periphery of the hinge tube 3 forms a plurality of recess portions 32, 33 including V-shaped recess portions 32 and arc-shaped recess portions 33. As shown in FIG. 4, in the longitudinal cross-section view or the lateral view of the hinge tube 3, the cross-section shape or the lateral shape of the V-shaped recess portion 32 are V-shaped, and the cross-section shape or the lateral shape of the arc-shaped recess portion 33 are arc-shaped. More specifically, each recess portion 32, 33 surrounds the hinge tube 3 to form a circular recess portion. The recess portions 32, 33 are aligned along a longitudinal direction of the hinge tube, wherein a plurality of V-shaped recess portions 32 are paired adjacently. A spherical connecting portion 34 is formed between the two adjacent V-shaped recess portions 32. The sections near the two opposite ends of the hinge tube 3 does not form any recess portion but forms a straight section 35.

Figure 5:
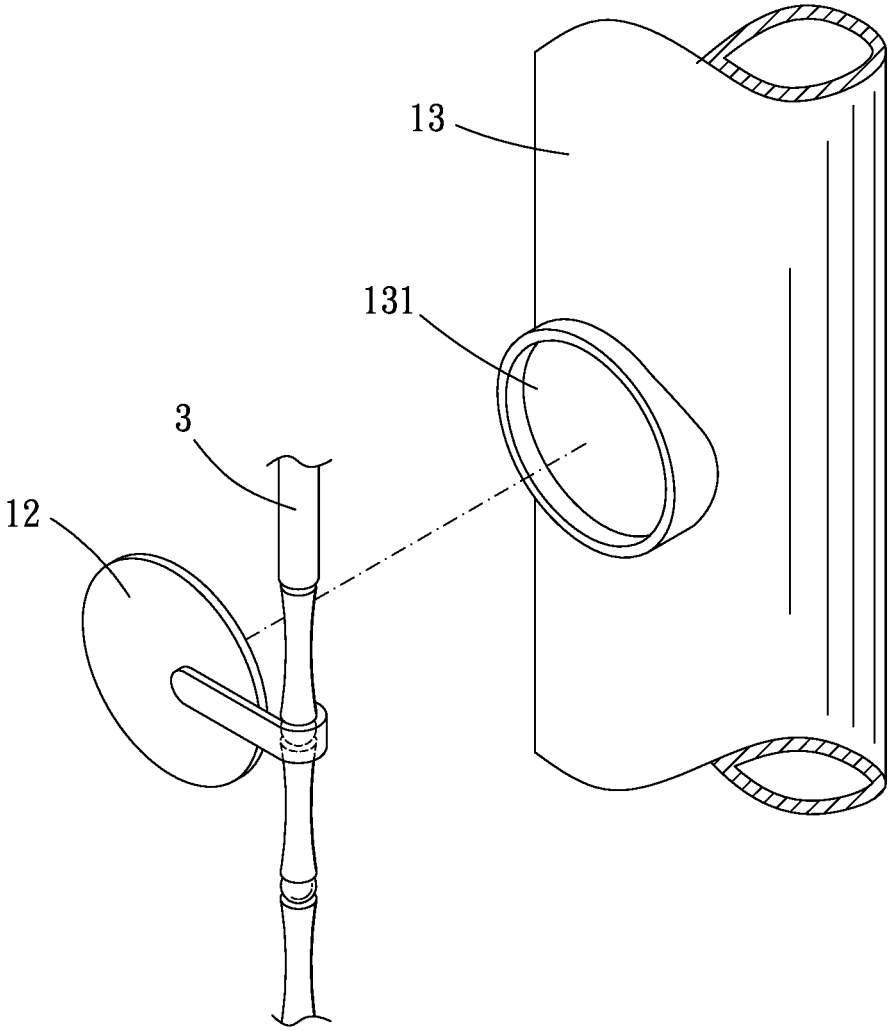
FIG. 5 is a partial breakdown view of FIG. 1.

Please refer to FIG. 1 to FIG. 5, the hinge tube 3 is provided to be disposed in a musical instrument, wherein the musical instrument also includes a body 13, at least one key 11 and at least one valves 12 in addition to the hinge tube 3. The body 13 has at least one tone hole 131. The hinge tube 3 is disposed rotatably on the body 13, and the hinge tube 3 extends along surface of the body 13 and is substantially parallel to the longitudinal direction of the body 13. The keys 11 and the valves 12 are disposed on the hinge tube 3 and are linked-up with the hinge tube 3 respectively. The hinge tube 3 is able to rotate in its axis and to bring the keys 11 and the valves 12 move simultaneously to open or to shut the corresponding tone holes 131 on the body 13. More preferably, the keys 11 and the valves 12 are disposed by welding or gluing. Solder or glue is filled between the hinge tube 3 and the keys 11 or between the hinge tube 3 and the valves 12 to enable the keys 11 and the valves 12 to be fixed to the hinge tube 3 respectively. However, other means to fix also works possibly. In the embodiment as shown in FIG. 5, the valve 12 is disposed on one of the connecting portions and two adjacent V-shaped recess portions of the hinge tube 3. The space between the valve 12 and hinge tube 3 is enough to be filled with solder or glue. In other possible embodiment, fixing the valves or the keys to the arc-shaped recess portions is also practicable.

By means of the structure mentioned above, a maker is able to identify the positions on which the valves and the keys should be disposed by the positions of the recess portions when fixing the hinge tube and the valves, and confirming the positions is not essential anymore. Thus, manufacturing is facilitated, and efficiency is increased.

Secondly, the recess portions provide enough space for filling solder or glue when fixing the valves and the keys. Therefore, the valves and the keys are able to be fixed to the hinge tube firmly, and the stability of instrument is promoted.

Moreover, due to the larger surface area of hinge tube provided by the recess portions, solder or glue can stick to the hinge tube tightly, and the stability of product is increased.

Besides, when the valves are fixed to the hinge tube by screw or other means, the rugged surface of the recess portion can provide higher friction force to stabilize the screws and the valves.

In conclusion, the hinge tube of the present invention is quite inventive that the efficiency of manufacture is promoted and the stability of instrument is also increased.

What is claimed is:

1. A musical instrument, including:

at least one hinge tube, the hinge tube having a periphery surrounding the hinge tube, the periphery extending from one end to the other end of the hinge tube, the periphery forming at least one recess portion;

a body, the hinge tube being disposed rotatably on the body, the hinge tube being able to rotate on an axis of the hinge tube, the body has at least one tone hole;

at least one key, being disposed on the hinge tube and links-up with the hinge tube;

at least one valve, being disposed on the hinge tube and links-up with the hinge tube;

wherein the key and the valve move when the hinge tube rotates to enable the valve to open or to shut the tone hole.

2. The musical instrument of claim 1, wherein at least one of the key and the valve is disposed on the recess portion of the hinge tube.

3. The musical instrument of claim 1, wherein the recess portion extends and surrounds the hinge tube to be circular.

4. The musical instrument of claim 1, wherein the periphery forms a plurality of recess portion, the recess portions are aligned along a longitudinal direction of the hinge tube.

5. The musical instrument of claim 1, wherein the periphery forms a plurality of recess portion, the recess portions are aligned along a longitudinal direction of the hinge tube.

6. The musical instrument of claim 3, wherein the periphery forms a plurality of recess portion, the recess portions are aligned along a longitudinal direction of the hinge tube.

7. The musical instrument of claim 6, wherein the hinge tube forms at least one connecting portion between two adjacencies of the recess portions, the connecting portion is a sphere.

* * * * *